US007064631B2

(12) United States Patent
Shih

(10) Patent No.: US 7,064,631 B2
(45) Date of Patent: Jun. 20, 2006

(54) HIGH FREQUENCY FILTER

(75) Inventor: Cheng-yen Shih, Taoyuan County (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 18 days.

(21) Appl. No.: 10/891,010

(22) Filed: Jul. 15, 2004

(65) Prior Publication Data

US 2005/0140471 A1 Jun. 30, 2005

(30) Foreign Application Priority Data

Dec. 24, 2003 (TW) ..... 92136778 A

(51) Int. Cl.
*H01P 1/203* (2006.01)

(52) U.S. Cl. ..... 333/204

(58) Field of Classification Search ..... 333/203–205, 333/219
See application file for complete search history.

(56) References Cited

U.S. PATENT DOCUMENTS

| | | | | |
|---|---|---|---|---|
| 3,668,569 | A * | 6/1972 | Herring | 333/204 |
| 4,701,727 | A * | 10/1987 | Wong | 333/204 |
| 5,311,159 | A * | 5/1994 | Miura et al. | 333/204 |
| 5,525,942 | A * | 6/1996 | Horii et al. | 333/134 |
| 6,483,404 | B1 * | 11/2002 | Ammar et al. | 333/204 |
| 6,597,259 | B1 * | 7/2003 | Peters | 333/134 |
| 6,670,206 | B1 * | 12/2003 | Kim et al. | 438/26 |
| 2004/0012467 | A1 * | 1/2004 | Salmela et al. | 333/204 |

* cited by examiner

*Primary Examiner*—Seungsook Ham
(74) *Attorney, Agent, or Firm*—Birch, Stewart, Kolasch & Birch, LLP

(57) ABSTRACT

A high-frequency filter whose main structure is formed by stacking a plurality of patterned substrates. The high-frequency filter includes a metal grounding layer, a signal input port, a signal output port, and a plurality of resonator layers having resonators coupled to one another for transmitting signals. By utilizing coupling among resonators located on adjacent layers respectively instead of coupling among resonators on a single layer in the prior planar patterned filter, the structure of the high-frequency filter in the invention can be changed according to process limitations.

20 Claims, 5 Drawing Sheets

HIGH FREQUENCY FILTER

This Nonprovisional application claims priority under 35 § U.S.C. 119(a) on Patent Application No(s). 092136778 filed in Taiwan, Republic of China on Dec. 24, 2003, the entire contents of which are hereby incorporated by reference.

BACKGROUND OF THE INVENTION a) Field of the invention

The present invention relates to a high-frequency filter and, more particularly, to a high-frequency filter with a patterned multi-layer structure.

b) Description of the Related Art

As electronic equipments miniaturize, their internal elements develop toward having a compacted aggregation. Thus, in order to integrate with other elements, a method for forming filters on planar circuit boards has been made available. FIG. 1A shows a top view of a conventional interdigital planar filter. FIG. 1B shows a sectional view of the filter taken along the line A–A' as shown in FIG. 1A. As shown in FIGS. 1A and 1B, the conventional interdigital planar filter is formed by patterning substrates with metal materials. The conventional interdigital planar filter includes a metal grounding surface 16, a substrate (such as a printed circuit board) 15, a plurality of resonators 11 formed on the substrate 15, an input port 12, and an output port 13. The resonators 11 are electrically connected to the metal grounding surface 16 via through holes 14 and thereby shorted to ground; the through holes 14 of adjacent resonators are located at opposite ends (interdigitated). Furthermore, the adjacent resonators 11 can couple with each other.

A signal is inputted into the input port 12 and transmitted to the resonator 11 connected thereof. The signal is then transmitted to the resonator 11 connected to the output port 13 through couplings between adjacent resonators 11 sequentially. At last, the signal is sent out from the output port 13. Generally, the distance d between adjacent resonators 11 greatly affects the performance of the interdigital planar filter because it can determine the coupling strength between the two resonators. Common printed circuit boards have a lower dielectric constant (less than 5), which causes their electric field to be more spread out; therefore, if these printed circuit boards are used as substrates to make interdigital planar filters, couplings between adjacent resonators are easier to occur and the distance therebetween is often greater.

Thus, a technology using ceramic materials as substrate has been developed for the purpose of minimizing filter sizes. However, ceramic materials have a very high dielectric constant (usually greater than 7.8). If interdigital planar filters are to be made on ceramic materials, adjacent resonators have to be in extreme proximity in order to accomplish the required coupling strength; the distance d has to be smaller than 100 μm, which is not feasible with the current processing technology. Hence, it is difficult to fabric interditial planar filters on ceramic substrates due to the essential spacing required.

In view of the above problem, a filter that is able to change its structure to accommodate process limitations would solve the problems; at the same time, the filter can be made efficiently on ceramic substrates and the size of the filter can be minimized.

SUMMARY OF THE INVENTION

An object of the invention is to provide a high-frequency filter, in which its structure can be adjusted in regards to the process limitations, and the high-frequency filter is easily made on ceramic substrates leading to minimization of the filter.

The first embodiment of the invention provides a high-frequency filter composed of a plurality of patterned substrates stacked together, and each patterned substrate includes a top surface and a bottom surface. The high-frequency filter includes a first metal grounding layer having a first grounding surface, a plurality of resonator layers each having at least one resonator, and a signal input port and a signal output port, both located on one of the plurality of resonator layers. Every one of the resonators has a grounding end electrically connected to the first grounding surface, and the resonators are arranged in the same direction and disposed so that coupling occurs between each two resonators that are separately situated on adjacent resonator layers.

Through the design of the invention, the structure of the high-frequency filter can be changed according to the process limitations, and thus the problem involving difficulties of making conventional interdigital planar filters on ceramic substrates is solved.

DETAILED DESCRIPTION OF THE INVENTION

Figure 1A:
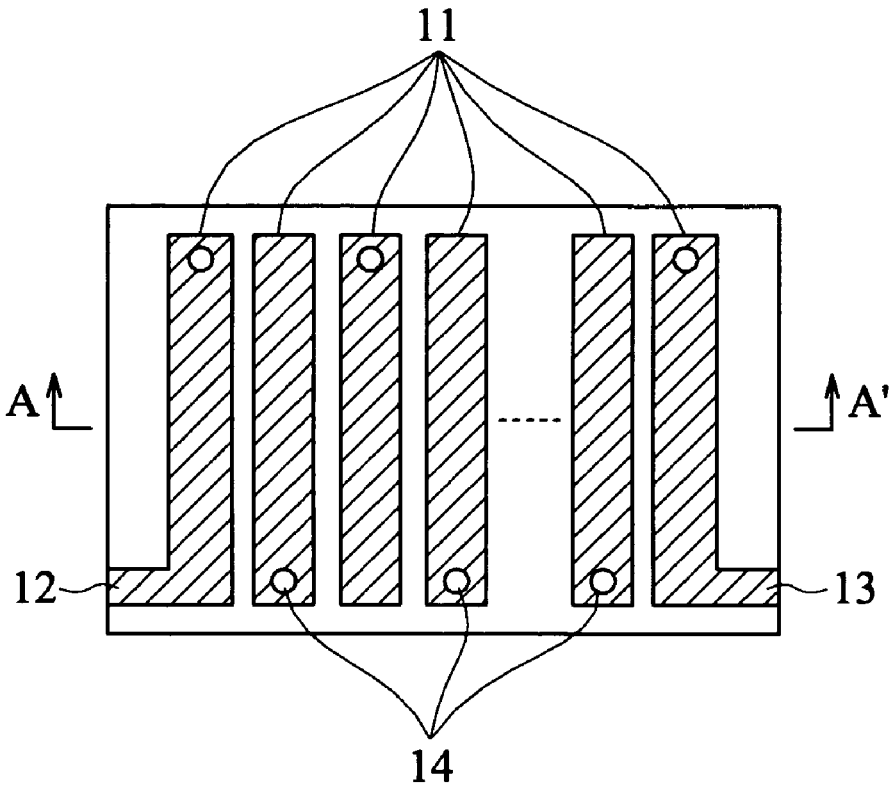
FIG. 1A (PRIOR ART)
FIG. 1A is a top view of a conventional interdigital planar filter.
Figure 1B:
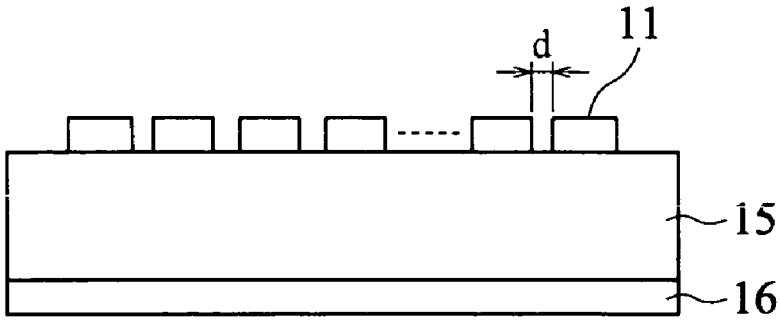
FIG. 1B (PRIOR ART)
FIG. 1B is a cross-sectional view of the planar filter taken along the line A–A' shown in FIG. 1A.

The invention may be described with greater clarity and particularity by reference to the accompanying drawings. The same reference numerals refer to the same parts throughout the various figures.

A high-frequency filter, according to the invention, has a main structure formed by stacking a plurality of patterned substrates, the high-frequency filter includes at least one metal grounding layer, a signal input port, a signal output port, a plurality of resonator layers for transmitting signals. The plurality of resonator layers have resonators that short to ground and are able to couple with one another. The function and arrangement of each element is described in the following detailed description of the embodiments.

Figure 2A:
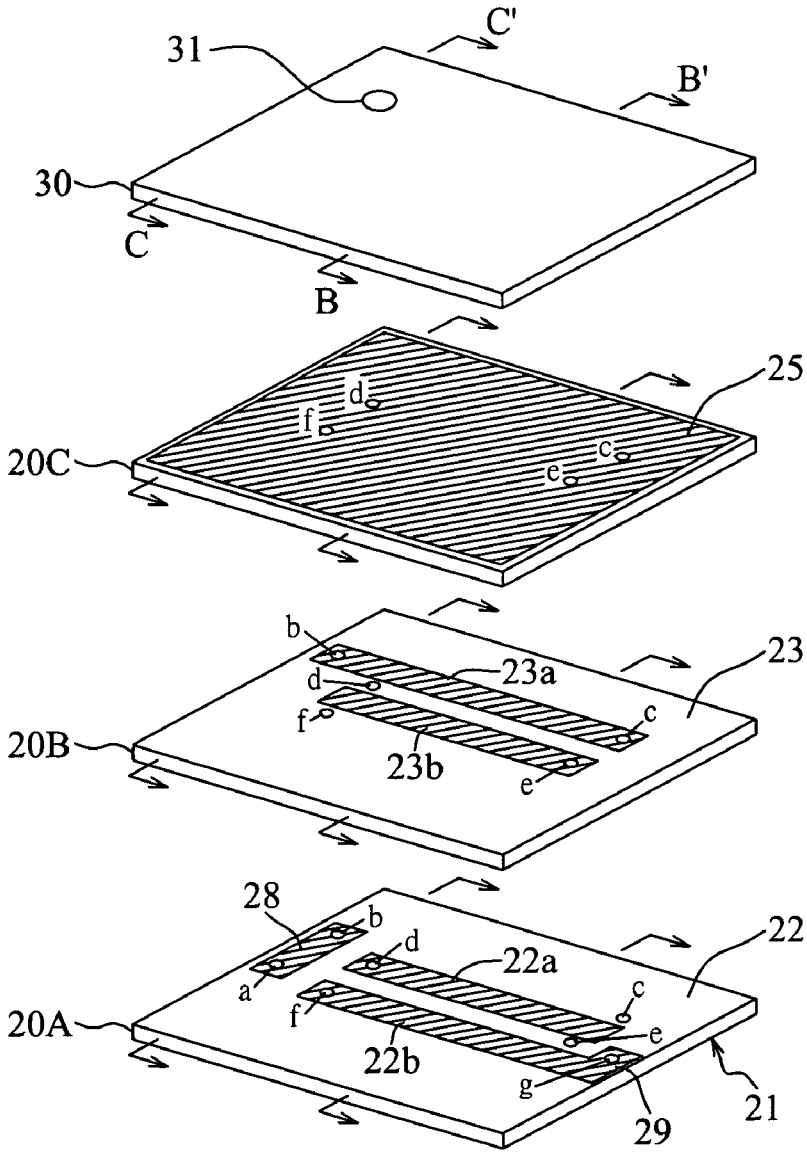
FIG. 2A is an exploded view of a high-frequency filter, according to the first embodiment of the invention.

Referring to FIG. 2A, a high-frequency filter according to the first embodiment of the invention is formed by three patterned substrates 20A, 20B, and 20C stacked together. The patterned substrates are made of a dielectric material, preferably a ceramic material so that the low temperature co-fired ceramic (LTCC) technology can be used, and the patterns on the patterned substrates are formed with metal materials. A first metal grounding layer 21 and a second metal grounding layer 25 are formed on the bottom surface of the lowest patterned substrate 20A and the top surface of the highest patterned substrate 20C, respectively. Furthermore, the second metal grounding layer 25 is a grounding surface formed on the entire top surface of the patterned substrate 20C.

Figure 2B:
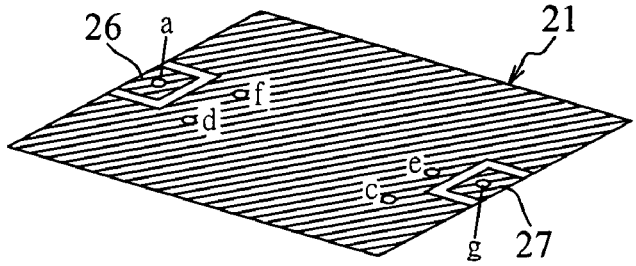
FIG. 2B is a bottom view of the high-frequency filter, according to the first embodiment of the invention (schematic diagram of the first metal grounding layer)

Referring to FIG. 2B, the first metal grounding layer 21 has contacting areas 26, 27 on its two ends for receiving signals by connecting to external devices, while the other area of the first metal grounding layer 21 is a grounding surface. The contacting areas 26, 27 are isolated from the grounding surface. It is to be understood that the second metal grounding layer 25 can be omitted to simplify the manufacture process, and moreover, an identification layer 30 for determining the direction of the filter may be added on the second metal grounding layer 25.

Figure 3A:
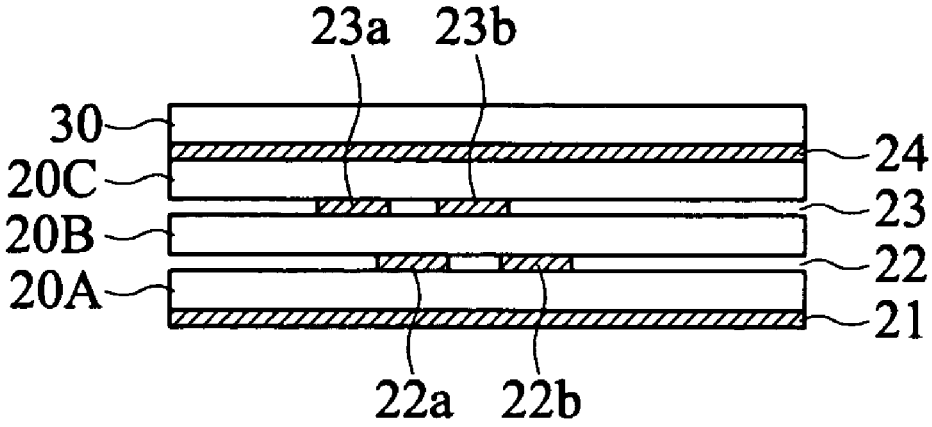
FIG. 3A is a cross-sectional view of the high-frequency filter taken along the line B–B' in FIG. 2A.

As shown in FIG. 2A, resonator layers 22, 23 are formed separately on the top surfaces of the patterned substrates 20A, 20B, respectively. The resonator layers 22, 23 each has at least one linear resonator and all resonators are arranged in the same direction (in parallel). It needs to be noted that the simplified drawing only depicts resonators 22*a*, 22*b* (on the resonator layer 22) and resonators 23*a*, 23*b* (on the resonator layer 23) for description purpose. Each resonator has an grounding end that is able to connect to the first metal grounding layer 21 and the second grounding layer 25 concurrently via a through hole, and thus short to ground. For example, the resonator 23*a* is short to ground via a through hole c, and the resonator 22*a* is short to ground via a through hole d. FIG. 3A is used to describe the relative positions between the resonators. As shown in FIG. 3A, when all resonators are viewed from the top of the filter, the sequence of resonators from left to right is: 23*a*, 22*a*, 23*b*, 22*b*. In this embodiment, the resonators overlap partially with adjacent resonators, but in other embodiments, the adjacent resonators may have a distance thereinbetween. When the distance is appropriately controlled, any two resonators that are on adjacent layers individually and are adjacent (or partially overlapped) when all resonators viewed from the top of the filter are able to couple with each other. For instance, the resonator 22*a* can couple with the resonators 23*a*, 23*b* separately, and the resonator 23*b* can couple with the resonators 22*a*, 22*b* separately. In the invention, similar to the structure of conventional interdigital filters, the grounding ends (through holes) of any two resonators that lie on adjacent layers and couple with each other are on opposite sides of the two resonators.

Figure 3B:
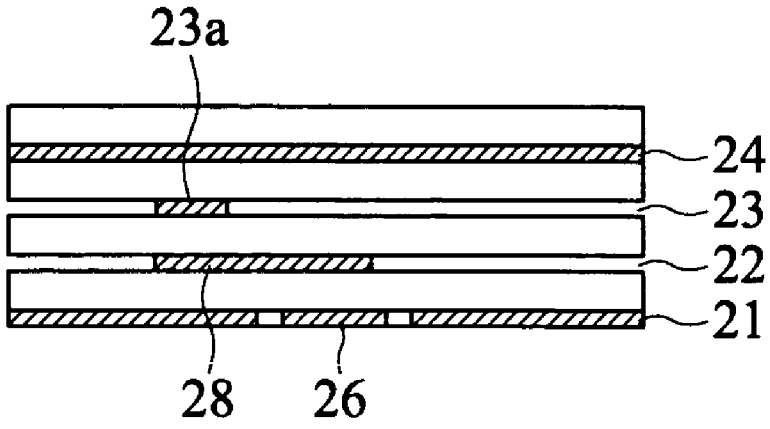
FIG. 3B is a cross-sectional view of the high-frequency filter taken along the line C–C' in FIG. 2A.

The resonator layer 22 further includes a signal input port 28 and a signal output port 29 as illustrated in FIG. 2A. The signal input port 28 electrically connects to the contacting area 26 of the first metal grounding layer 21 via a through hole a, and the signal output port 29 electrically connects with the contacting area 27 of the first metal grounding layer 21 via a through hole g. On the other hand, the signal input port 28 electrically connects to the resonator 23*a* situated on the upper layer via a through hole b, and the signal output port 29 connects directly to the resonator 22*b* situated on the same layer. FIG. 3B illustrates the relative positions between the contacting area 26, the signal input port 28, and the resonator 23*a*; the left side of the signal input port 28 is below the resonator 23*a* and the right side is above the contacting area 26. The identification layer 30 has an identification sign 31 disposed close to the signal input port 28 or the signal output port 29 for identifying the direction of the high-frequency filter.

The path along which signals are transmitted in the high-frequency filter according to this embodiment is described below. A signal first enters the contacting area 26 of the first metal grounding layer 21 and then is transmitted to the signal input port 28 via the through hole a. The signal is then transmitted to the resonator 23*a* via the through hole b, and to the resonators 22*a*, 23*b* and 22*b* sequentially by the couplings therebetween. Finally, the signal transmitted to the resonator 22*b* is sent to the signal output port 29, and then to the contacting area 27 of the first metal grounding layer 21 via the through hole g, and is outputted therefrom.

As described above, the invention uses coupling between resonators on adjacent layers to replace the coupling between resonators on a single layer in the conventional planar filter, and thus the structural design of the high-frequency filter of the invention has more flexibility. For instance, the distance between resonators on the same layer can be adjusted according to the process limitations, and the distance between resonators on different layers can also be adjusted according to the dielectric constant of the substrate and the required coupling strength. Thus, if the structure of the invention is applied to ceramic substrates, the problem encountered by the conventional interdigital filter is solved.

Figure 4A:
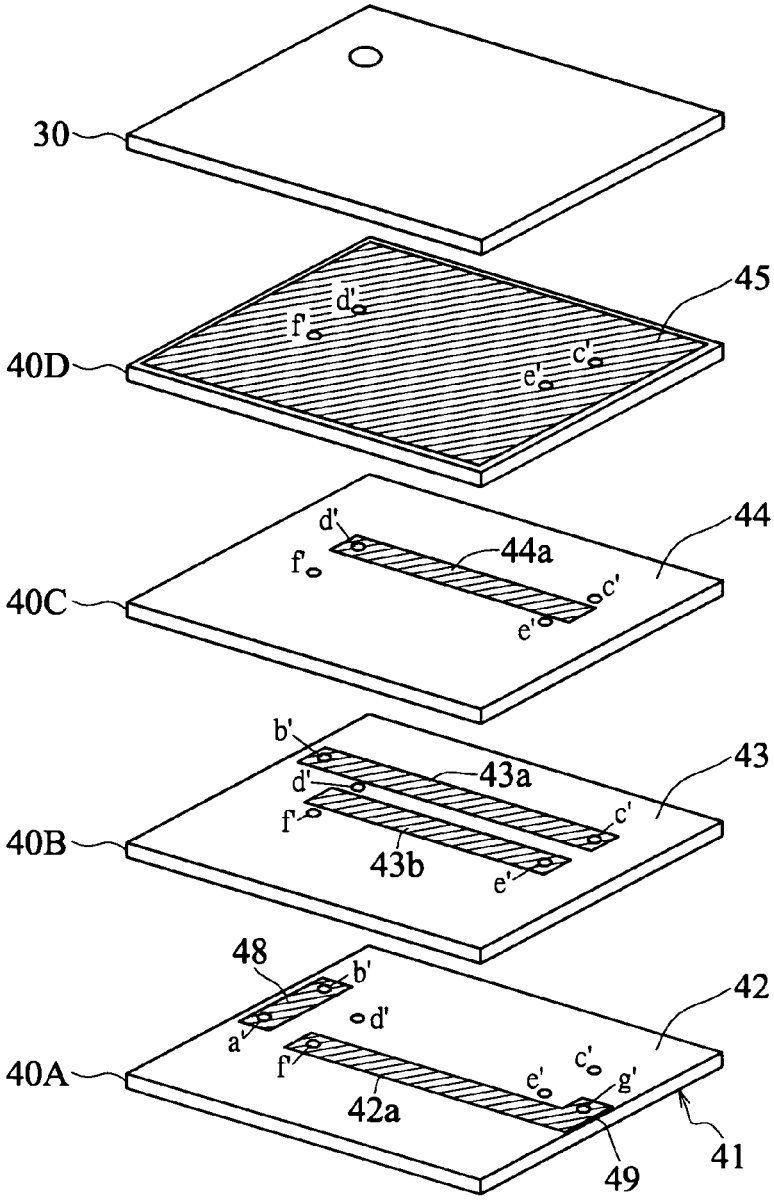
FIG. 4A is an exploded view of a high-frequency filter, according to the second embodiment of the invention.
Figure 4B:
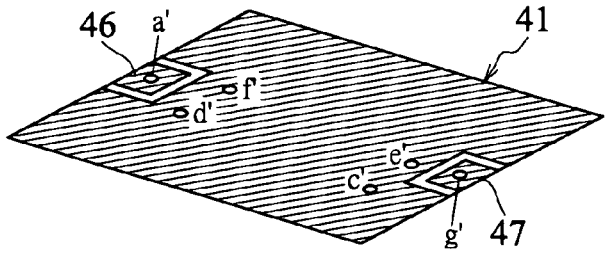
FIG. 4B is a bottom view of the high frequency-filter, according to the second embodiment of the invention (schematic diagram of the first metal grounding layer)

Referring to FIGS. 4A and 4B, the structure of the high-frequency filter in the second embodiment is similar to that in the first embodiment, except that the high-frequency filter in the second embodiment has three resonator layers 42, 43, 44. In the high-frequency filter according to this embodiment, signals are transmitted through the following elements in sequence: the contacting area 46, the signal input port 48, the resonator 43*a*, the resonator 44*a*, the resonator 43*b*, the resonator 42*a*, the signal output port 49, and the contacting area 47.

As shown in the second embodiment, the high-frequency filter according to the invention is not limited to have only two resonator layers but is able to add resonator layers in response to the requirement of the high-frequency filter. The amount and arrangement of resonators on each resonator layer can be adjusted according to specification needs.

Figure 5A:
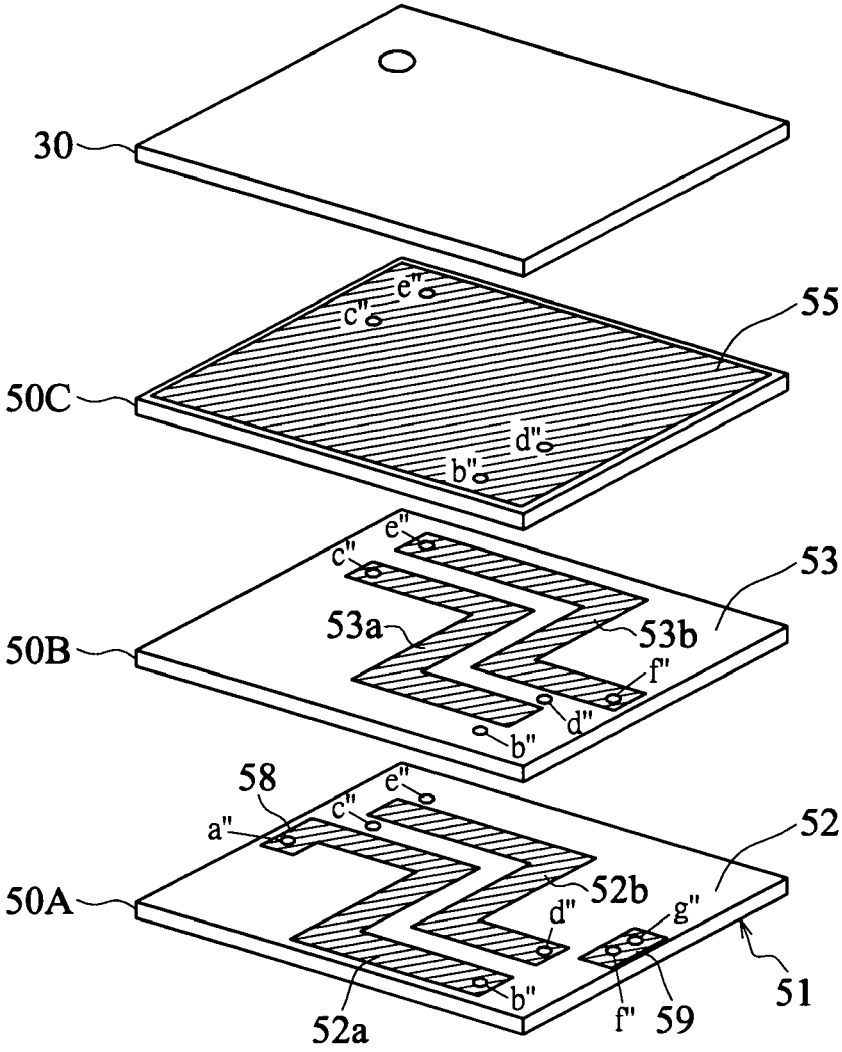
FIG. 5A is an exploded view of a high-frequency filter, according to the third embodiment of the invention.
Figure 5B:
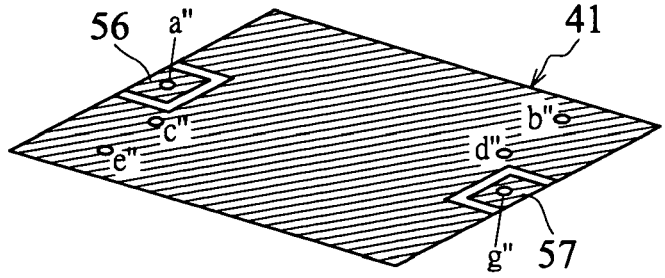
FIG. 5B is a bottom view of the high-frequency filter, according to the third embodiment of the invention (schematic diagram of the first metal grounding layer).

Referring to FIGS. 5A and 5B, the structure of the high-frequency filter in the third embodiment is similar to that in the first embodiment, except that all of the resonators are in one zigzag shape. Moreover, a signal input port 58 connects directly with a resonator 52*a* of the same layer, and a signal output port 59 electrically connects to a resonator 53*b* of the upper layer via a through hole f". Signals are transmitted in the high-frequency filter of this embodiment by passing through the following elements in sequence: the contacting area 56, the signal input port 58, the resonator 52*a*, the resonator 53*a*, the resonator 52*b*, the resonator 53*b*, the signal output port 59, and the contacting area 57.

As shown in the third embodiment, the resonators of the high-frequency filter according to the invention can be made into zigzag or curviform shapes for further reducing the size of the filter, so long as the arrangement of the resonators fulfills the aforementioned requirements. Furthermore, the signal input port and signal output port can be placed on any resonator layer depending on the needs, but preferably on the lowest resonator layer for simple processing purpose (or on the resonator layer adjacent to a metal grounding layer with contacting areas). The connecting methods of the signal input port, signal output port, and the resonators can be determined based on the structure needed for the filter; for instance, connected by through holes or integration. Moreover, each through hole is filled with metal materials for transmitting signals or shorting to ground.

While the invention has been described by way of example and in terms of the preferred embodiment, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A high-frequency filter formed by stacking a plurality of patterned substrates each having a top surface and a bottom surface, the high frequency filter comprising:

a first metal grounding layer having a first grounding surface;

a plurality of resonator layers each having at least one resonator, wherein each resonator has a grounding end electrically connected to the first grounding surface, and the resonators are arranged in a same direction and disposed so that coupling occurs between each two resonators that are separately situated on adjacent resonator layers;

a signal input port formed on one of the resonator layers, wherein the signal input port and a first resonator of the resonators are located on different resonator layers; and a signal output port formed on one of the resonator layers.

2. The high-frequency filter as described in claim 1, wherein when all resonators are viewed from the top of the high-frequency filter, the two coupling resonators are partially overlapped.

3. The high-frequency filter as described in claim 1, wherein when all resonators are viewed from the top of the high-frequency filter, the two coupling resonators are adjacent.

4. The high-frequency filter as described in claim 1, wherein the grounding ends of the two coupling resonators are separately located on their two opposite sides.

5. The high-frequency filter as described in claim 1, wherein the plurality of patterned substrates are made of ceramic materials and are stacked by low temperature co-fired ceramic (LTCC) technique.

6. The high-frequency filter as described in claim 1, wherein the grounding end of each resonator is electrically connected to the first grounding surface via a through hole.

7. The high-frequency filter as described in claim 1, wherein the first metal grounding layer is formed on the bottom surface of the lowest patterned substrate, and the plurality of resonator layers are separately formed on the top surface of the lowest patterned substrate and on the top surfaces of the other patterned substrates.

8. The high-frequency filter as described in claim 7, further comprising a second metal grounding layer having a second grounding surface, the second metal grounding layer is formed on the top surface of the highest patterned substrate, wherein the grounding end of each resonator is electrically connected to the first grounding surface and the second grounding surface concurrently.

9. The high-frequency filter as described in claim 8, wherein the grounding end of each resonator is electrically connected to the first and the second grounding surface concurrently via a through hole.

10. The high-frequency filter as described in claim 8, further comprising an identification layer located above the second metal grounding layer for identifying the direction of the high frequency filter.

11. The high-frequency filter as described in claim 1, wherein the first metal grounding layer further comprises a first and a second contacting areas for connecting with external devices, and the two contacting areas are isolated from the first grounding surface.

12. The high-frequency filter as described in claim 11, wherein the signal input port is electrically connected to the first contacting area and transmits an input signal to the first resonator of the resonators, and the signal output port is electrically connected to the second contacting area and receives an output signal from a last resonator of the resonators.

13. The high-frequency filter as described in claim 12, wherein the signal input port is electrically connected to the first contacting area via a through hole, and the signal output port is electrically connected to the second contacting area via a through hole.

14. The high-frequency filter as described in claim 12, wherein the signal input port transmits the input signal to the first resonator via a through hole that is electrically connected to the first resonator and is on the opposite side of the grounding end of the first resonator.

15. The high-frequency filter as described in claim 12, wherein the signal output port and the last resonator are located on different resonator layers, and the signal output port receives the output signal from the last resonator via a through hole that is electrically connected to the last resonator and is on the opposite side of the grounding end of the last resonator.

16. The high-frequency filter as described in claim 12, wherein the signal input port and the first resonator are located on the same resonator layer, and the signal input port is directly connected to the first resonator.

17. The high-frequency filter as described in claim 12, wherein the signal output port and the last resonator are located on the same resonator layer, and the signal output port is directly connected to the last resonator.

18. The high-frequency filter as described in claim 1, wherein the shape of the resonators is linear, curviform, or zigzag.

19. The high-frequency filter as described in claims 6, wherein each of the through holes is filled with metal materials.

20. A high-frequency filter formed by stacking a plurality of patterned substrates each having a top surface and a bottom surface, the high frequency filter comprising:

a first metal grounding layer having a first grounding surface;

a plurality of resonator layers each having at least one resonator, wherein each resonator has a grounding end electrically connected to the first grounding surface, and the resonators are arranged in a same direction and disposed so that coupling occurs between each two resonators that are separately situated on adjacent resonator layers;

a signal input port formed on one of the resonator layers; and a signal output port formed on one of the resonator layers, wherein the signal output port and a last resonator of the resonators are located on different resonator layers.

* * * * *